US008517799B2

(12) United States Patent
Panergo et al.

(10) Patent No.: US 8,517,799 B2
(45) Date of Patent: Aug. 27, 2013

(54) ROBOTIC SURFACE PREPARATION BY A RANDOM ORBITAL DEVICE

(75) Inventors: Reynold Rullan Panergo, Lynnwood, WA (US); James C. Vanavery, Renton, WA (US)

(73) Assignee: The Boeing Company, Chicago, IL (US)

( * ) Notice: Subject to any disclaimer, the term of this patent is extended or adjusted under 35 U.S.C. 154(b) by 416 days.

(21) Appl. No.: 12/962,594

(22) Filed: Dec. 7, 2010

(65) Prior Publication Data

US 2012/0142255 A1 Jun. 7, 2012

(51) Int. Cl.
*B24B 1/00* (2006.01)

(52) U.S. Cl.
USPC ..... 451/28; 451/355; 451/358; 451/359; 451/41

(58) Field of Classification Search
USPC ..... 451/5, 28, 1, 3, 355–359, 41, 508, 451/509, 494, 360; 901/27–29; 29/559; 403/56, 76, 77, 90, 114, 115, 123–125
See application file for complete search history.

(56) References Cited

U.S. PATENT DOCUMENTS 1,368,752 A * 2/1921 Rauworth ..... 451/174
2,993,311 A * 7/1961 West ..... 464/120
3,197,552 A * 7/1965 Flair ..... 174/86
3,226,888 A * 1/1966 Erenyi ..... 451/494
3,497,083 A * 2/1970 Anderson et al. ..... 414/738
4,685,349 A * 8/1987 Wada et al. ..... 74/490.04
5,016,489 A * 5/1991 Yoda ..... 74/490.03
5,144,774 A * 9/1992 Conboy ..... 451/356
5,161,331 A * 11/1992 Zambon ..... 451/159
5,220,849 A * 6/1993 Lande et al. ..... 74/479.01
5,248,341 A * 9/1993 Berry et al. ..... 118/698
5,313,854 A * 5/1994 Akeel ..... 74/490.04
5,377,566 A 1/1995 Mandigo
5,445,553 A * 8/1995 Cryer et al. ..... 451/7
5,607,343 A 3/1997 Keith, Jr.
5,725,071 A * 3/1998 Brice ..... 184/6.26
5,738,568 A * 4/1998 Jurjevic et al. ..... 451/41
5,987,217 A * 11/1999 Wisniewski et al. ..... 700/245
5,997,047 A * 12/1999 Pimentel et al. ..... 285/55
6,059,644 A * 5/2000 Manor et al. ..... 451/490
6,116,998 A * 9/2000 Damgaard et al. ..... 451/490
6,193,337 B1 2/2001 Roeker
6,224,474 B1 * 5/2001 Vander Voort ..... 451/494
6,352,227 B1 * 3/2002 Hathaway ..... 248/160
6,394,887 B1 * 5/2002 Edinger ..... 451/494
6,394,892 B2 * 5/2002 Hanisch et al. ..... 451/259
6,619,146 B2 * 9/2003 Kerrebrock ..... 74/25
6,991,529 B2 * 1/2006 Annis et al. ..... 451/557
7,022,004 B2 * 4/2006 Bohler ..... 451/366

(Continued)

OTHER PUBLICATIONS

Nagata et al., "Robotic sanding system for new designed furniture with free-formed surface," Robotics and Computer-Integrated Manufacturing 23, pp. 371-379 (2007).

*Primary Examiner* — George Nguyen
(74) *Attorney, Agent, or Firm* — Hugh P. Gortler

(57) ABSTRACT

An apparatus includes a surface preparation device for moving a backing pad in a random orbital motion, a first ball joint connected to the device, a second ball joint connected to the first ball joint; and a robotic end effector, connected to the second ball joint, for pressing the device against a surface.

20 Claims, 8 Drawing Sheets

(56) References Cited

U.S. PATENT DOCUMENTS

| | | | | |
|---|---|---|---|---|
| 7,131,902 | B2 * | 11/2006 | Hope | 451/533 |
| 7,144,313 | B1 | 12/2006 | Greenwood | |
| 8,051,796 | B2 * | 11/2011 | Clifford | 118/323 |
| 8,052,506 | B2 * | 11/2011 | Rivard et al. | 451/490 |
| 2002/0076265 | A1 * | 6/2002 | Yagyu | 403/56 |
| 2003/0180088 | A1 * | 9/2003 | Camevali | 403/56 |
| 2004/0082285 | A1 * | 4/2004 | Bohler | 451/359 |
| 2004/0102135 | A1 * | 5/2004 | Wood et al. | 451/5 |
| 2004/0102136 | A1 * | 5/2004 | Wood et al. | 451/5 |
| 2004/0132392 | A1 * | 7/2004 | Bohler | 451/360 |
| 2005/0011295 | A1 * | 1/2005 | Shiraki et al. | 74/490.02 |
| 2006/0207393 | A1 * | 9/2006 | Stupar | 81/177.75 |
| 2009/0007844 | A1 * | 1/2009 | Krogedal et al. | 118/313 |
| 2009/0044654 | A1 * | 2/2009 | Vaccani | 74/490.01 |
| 2012/0075399 | A1 * | 3/2012 | Polus | 347/110 |

* cited by examiner

ROBOTIC SURFACE PREPARATION BY A RANDOM ORBITAL DEVICE

BACKGROUND

A robotic system that can autonomously perform surface preparation, and apply primer, a base coat and a decorative coat to an aircraft would be desirable. Such a system would provide a consistent process. It would also eliminate human health hazards such as dust inhalation and poor ergonomics.

The surface preparation would include sanding of aircraft surfaces. Sanding with a random orbital sander would be desirable. A random orbital sander can sand in a random orbit at high speeds.

However, chattering can occur in a random orbital sander. The chattering is undesirable because the sanding medium does not stay normal to the surface being sanded. The chattering is also undesirable because it causes uncontrolled patterns or removal during sanding. Consequently, surface finish is non-uniform as a result of the chattering.

It would be desirable to reduce or eliminate the chattering in an orbital sander.

SUMMARY

According to an embodiment herein, an apparatus includes a surface preparation device for moving a backing pad in a random orbital motion, a first ball joint connected to the device, a second ball joint connected to the first ball joint; and a robotic end effector, connected to the second ball joint, for pressing the device against a surface.

According to another embodiment herein, an apparatus includes a robotic end effector, first and second ball joints connected serially, and a random orbital sander connected to the robotic end effector by the serially connected ball joints.

According to another embodiment herein, a method comprises using a robotic end effector coupled to a random orbital sander to attach and remove sanding media from a backing pad of the sander. Attaching a sanding medium includes stacking a plurality of sanding discs interleaved with thin metal discs, with each sanding disc being above its corresponding metal disc; and using the robotic end effector to move the sander, which has a magnetized backing pad, over the stack so that the metal disc is magnetically clamped to the backing pad. A sanding disc is clamped between its corresponding plate and the backing pad and thereby fastened to the backing pad.

DETAILED DESCRIPTION

Figure 1:
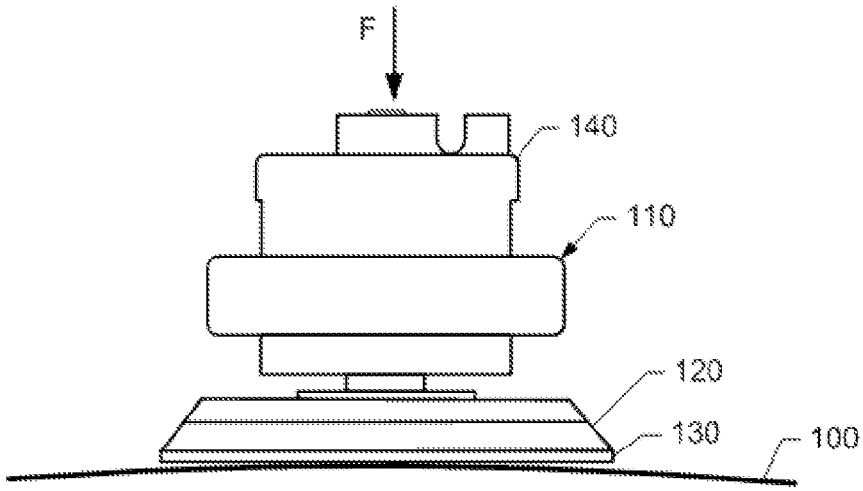
FIG. 1 is an illustration of a surface preparation device on a contoured surface.

Reference is made to FIG. 1, which illustrates a device 110 for preparing a surface 100. The surface 100 may be contoured of flat. The device 110 includes a motor (not shown) within a housing 140 for moving a backing pad 120 in a random orbital motion. The surface preparation is performed according to the media 130 attached to the backing pad 120. Examples of the media 130 include, but are not limited to sand paper, unwoven abrasive pads, and polishing media. The surface preparation includes, but is not limited to, sanding, abrading, polishing, and scrubbing.

During operation, a force is applied to the device 110 in the direction of the arrow F. The force presses the surface preparation device 110 against the surface 100, and the motor moves the backing pad 120 in a random orbital motion.

Figure 2:
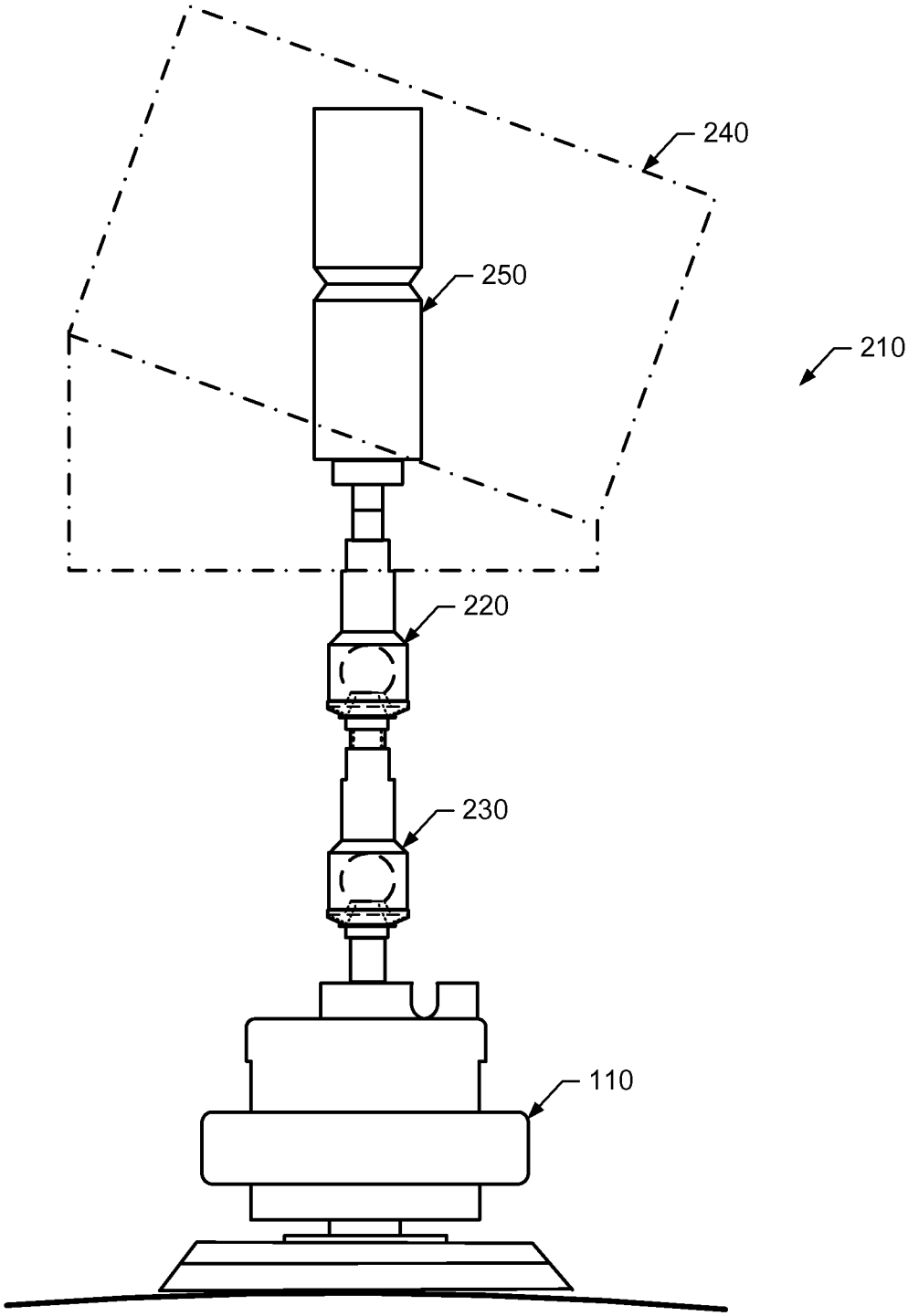
FIG. 2 is an illustration of an apparatus for performing surface preparation.

Reference is now made to FIG. 2, which illustrates an apparatus 210 for performing surface preparation on a contoured surface 100. The apparatus 210 includes the surface preparation device 110, a first ball joint 220 connected to the device 110, a second ball joint 230 connected to the first ball joint 230, and a robotic end effector 240 connected to the second ball joint 230.

The robotic end effector 240 includes a linear actuator 250. During operation, the linear actuator 250 applies a constant force to the serial connection of first and second ball joints 220 and 230. The ball joints 220 and 230, in turn, transmit the force to the surface preparation device 110, which is thereby pressed against the surface 100.

Figure 3:
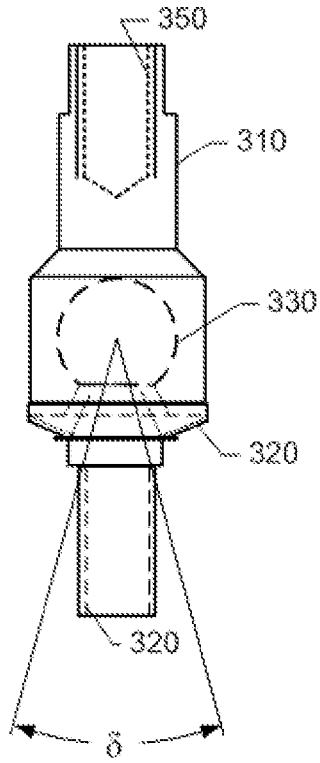
FIG. 3 is an illustration of a ball joint.

Additional reference is made to FIG. 3, which illustrates a ball joint 220, 230. Each ball joint 220 and 230 includes first and second rod ends 310 and 320 coupled with a spherical interface 330 that is allowed a swivel of up to angle $\delta$. In some embodiments, $\delta$=35 degrees. The ball joints 220 and 230 may be connected serially by engaging external threads 340 of the first ball joint 220 with internal threads 350 of the second ball joint 230.

Internal threads 350 of the first ball joint 220 engage the end effector 240. External threads 340 of the second ball joint 230 engage a housing of the surface preparation device 110.

The serially-connected ball joints 220 and 230 provide an unexpected result: they prevent the device 110 from chattering during operation. The two ball joints 220 and 230 allow for motion in the horizontal direction with an applied downward force applied at the top of the device 110 and centered. By preventing chattering, the device 110 stays normal to the surface 100, and the end effector 240 is able to maintain a constant downward pressure.

In some embodiments, the linear actuator 250 includes a pneumatic double compression cylinder connected to the second ball joint 230. The compression cylinder provides a linear force using compressed air. The compression cylinder is rigid in the direction of pad motion. A double acting compression cylinder is advantageous because the pressure stays constant throughout the entire stroke. In contrast, in a single acting cylinder, the force will change based on the displacement of an internal spring.

Regulation of the compressed air may be performed by a pressure transducer. The transducer regulates input pressure via a DC voltage. The transducer may be housed in a purged chamber for use in hazardous locations.

In some embodiments, the end effector 240 may further include an angled wrist base mounted to the linear actuator 250; and a robotic wrist attached to the wrist base. The wrist can position the pneumatic cylinder at any orientation (e.g., 0, 30, 45, and 90 degrees).

Figure 4:
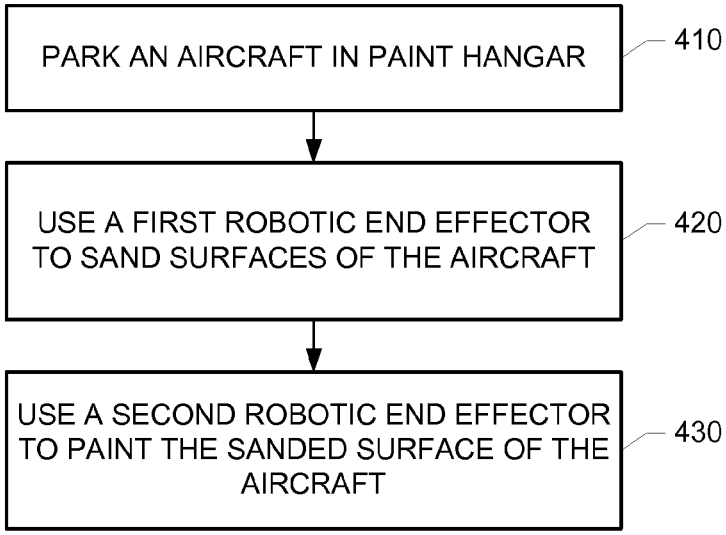
FIG. 4 is an illustration of a method of using the apparatus to paint an aircraft.

Reference is now made to FIG. 4, which illustrates a method of using the apparatus 210 to paint an aircraft. At block 410, an aircraft is parked in a paint hangar. In some embodiments, the paint hangar may be a class 1 division 1 (C1D1) location having the area of a football field. A C1D1 location refers to a location in which ignitable concentrations of such gases or vapors may exist.

At block 420, the apparatus 210 is used to sand surfaces of the aircraft. The device 110, which has sanding disc 130 attached to its backing pad 120, is operated without chattering. Consequently, a uniform surface finish is achieved.

At block 430, a second end effector is used to paint the sanded surfaces. The painting may be performed on the sanded surface while the apparatus 210 is sanding another surface.

The apparatus 210 may use pneumatic tools instead of electrical equipment to avoid sparking. A pneumatic apparatus is suitable for a C1D1 location.

During operation of the device 110, a spent sanding disc will be removed from the backing pad 120, and a new sanding disc will be reattached. The following paragraphs describe a system for using a robotic end effector to attach and remove sanding media from the backing pad 120 without any manual intervention.

Figure 5:
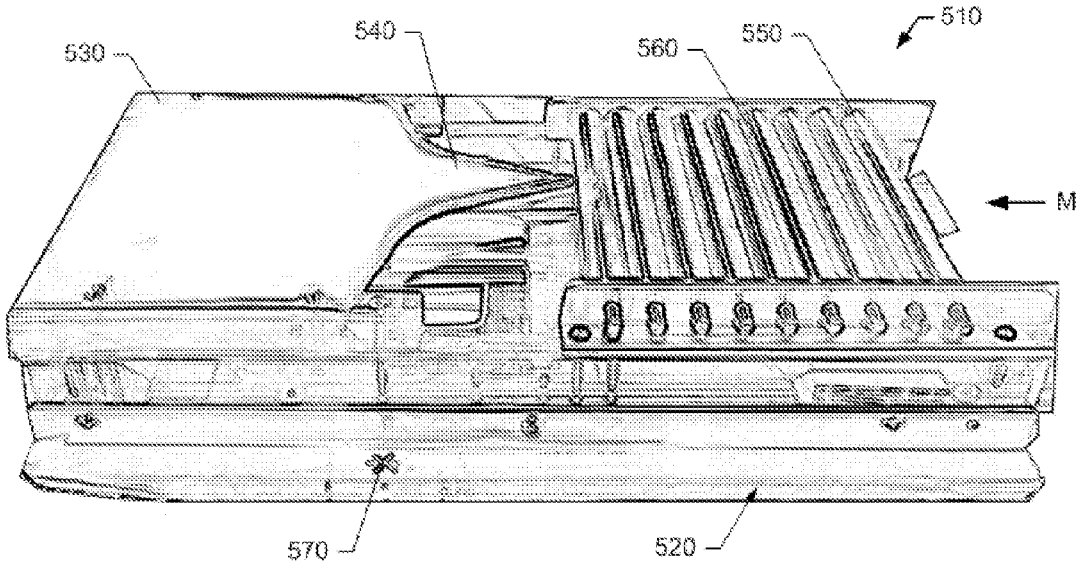
FIG. 5 is an illustration of a system for attaching and removing sanding discs to and from a random orbital sander without manual intervention.

Reference is now made to FIG. 5, which illustrates a system 510 for attaching and removing a sanding disc 130 from the backing pad 120 of the device 110. The attachment-removal system 510 includes a platform 520 (e.g., a table) and a wedge 530 on an upper surface of the platform 520. The wedge 530 has sharp, elongated tip 540 which will be referred to as a "shovel-nose" tip 540.

The attachment-removal system 510 further includes a roller table 550 for moving the device 110 towards the shovel nose rip 540. Direction of motion is indicated by the arrow M. The roller table 550 includes a plurality of rollers 560 extending transversely to the direction of motion.

To remove a sanding disc 130 from the device 110, the robotic end effector 240 places the device 110 on the roller table 550 with the sanding disc 130 resting on the rollers 560. The end effector 240 then moves the device 110 towards the shovel nose tip 540. The sanding disc 130 is moved over the rollers 540 with low friction (that is, much lower than moving the sanding disc 130 over a solid surface).

The shovel nose tip 540 is positioned at the interface of the backing pad 120 and the sanding disc 130. As the device 110 is moved into the shovel nose tip 540, the shovel nose tip 540 separates the sanding disc 130 from the backing pad 120 (see FIGS. 7*a* and 7*b*). The end effector 240 continues moving the device 110 in the direction of motion until the sanding disc 130 is completely separated from the backing pad 120 (see FIG. 7*c*). During removal, the sanding disc 130 is not being rotated.

Figure 6:
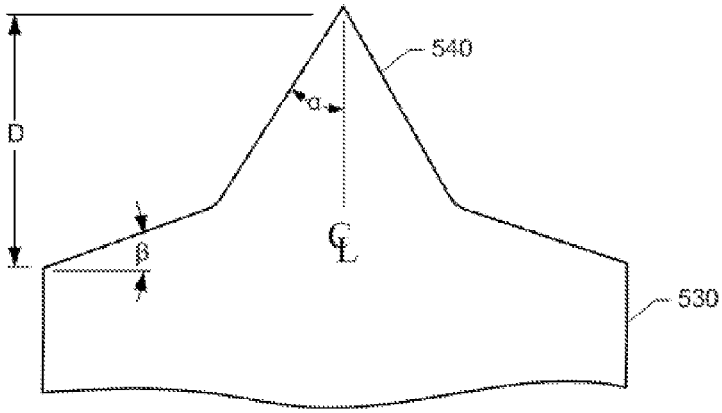
FIG. 6 is an illustration of a wedge of the system.

Additional reference is made to FIG. 6. The purpose of the wedge 530 is to gradually remove the sanding disc 130 from the backing pad 120. Primary angle of the tip 540 from a perpendicular center line may be $\alpha=40°\pm5°$, and secondary angle of the tip 530 may be $\beta=20°\pm5°$. Depth of the tip 540 is about D=4 inches. Using such a tip 540 the sanding disc 130 starts its separation from the center while the edges stay in contact with the backing pad 120. If the edges do not stay in contact, then the sanding disc 130 will fold underneath and will not be removed. Once the tip 540 of the wedge 530 has reached the end of the pad 120, then the remainder of the wedge 530 will gradually start separating the outer areas. Once the disc 130 is completed separated, it will fall into the bin located beneath the wedge 530.

A sanding disc 130 may be attached to the backing pad 120 by hook and loop material. The hook and loop material serves an additional function: the material on the backing pad 120 reduces friction as the sander 110 is being moved over the upper surface of the wedge 530. Thus, after the sanding disc 130 is separated, the hook and loop material moves along the wedge 530 with low friction.

After the sanding disc 130 has been removed, a tube (not shown) positioned at an end of the wedge 530 may be used to blow compressed air onto the backing pad 120. The compressed air blows off dust from the backing pad 120.

The use of a wedge 530 in combination with the ball joints 220 and 230 has a synergistic effect: it places the backing pad 120 in a known orientation, which enables a new sanding disc 120 to be attached.

Figure 7A:
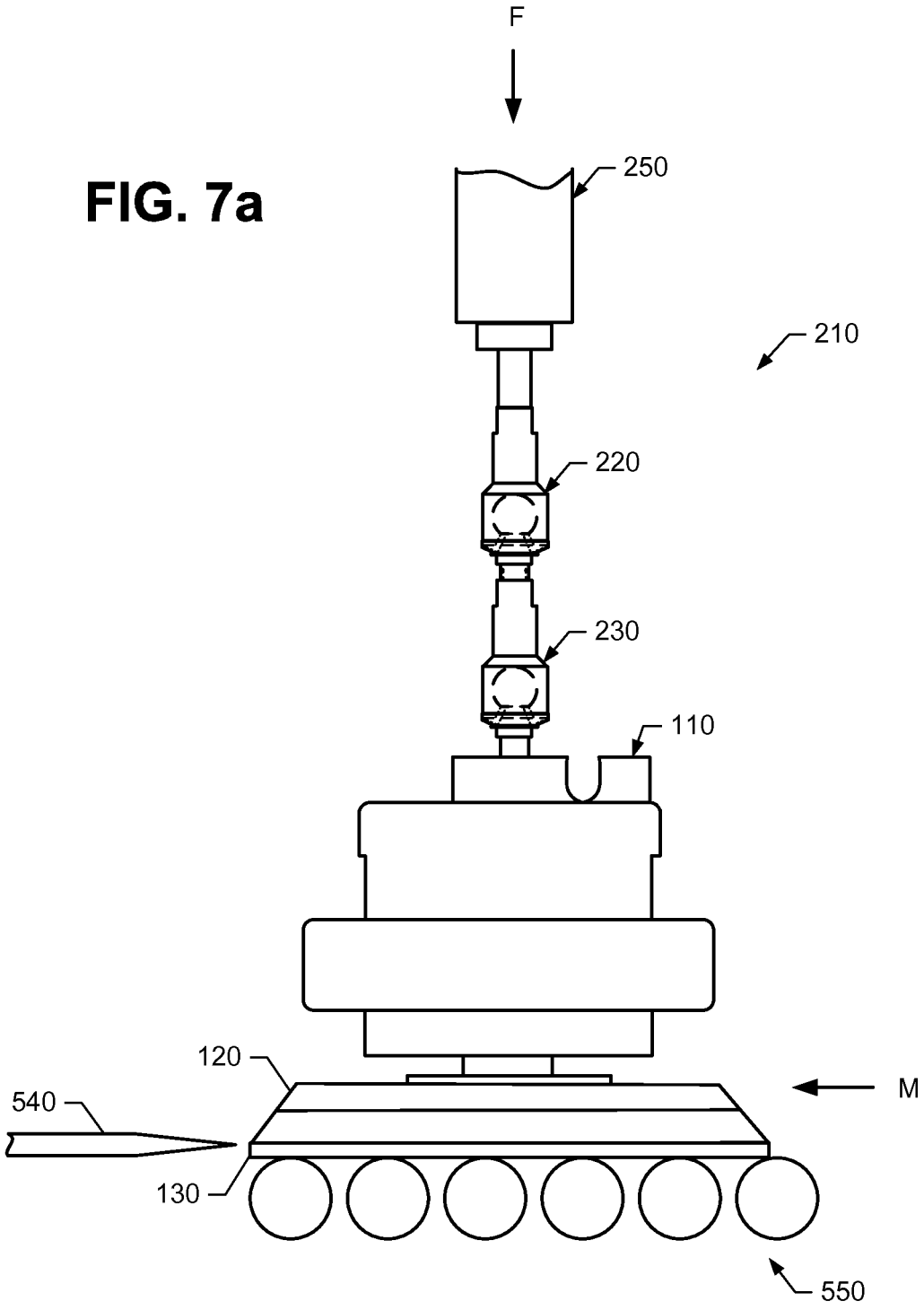
FIGS. 7*a*, 7*b* and 7*c* are illustrations of the random orbital sander during sanding disc removal.
Figure 7B:
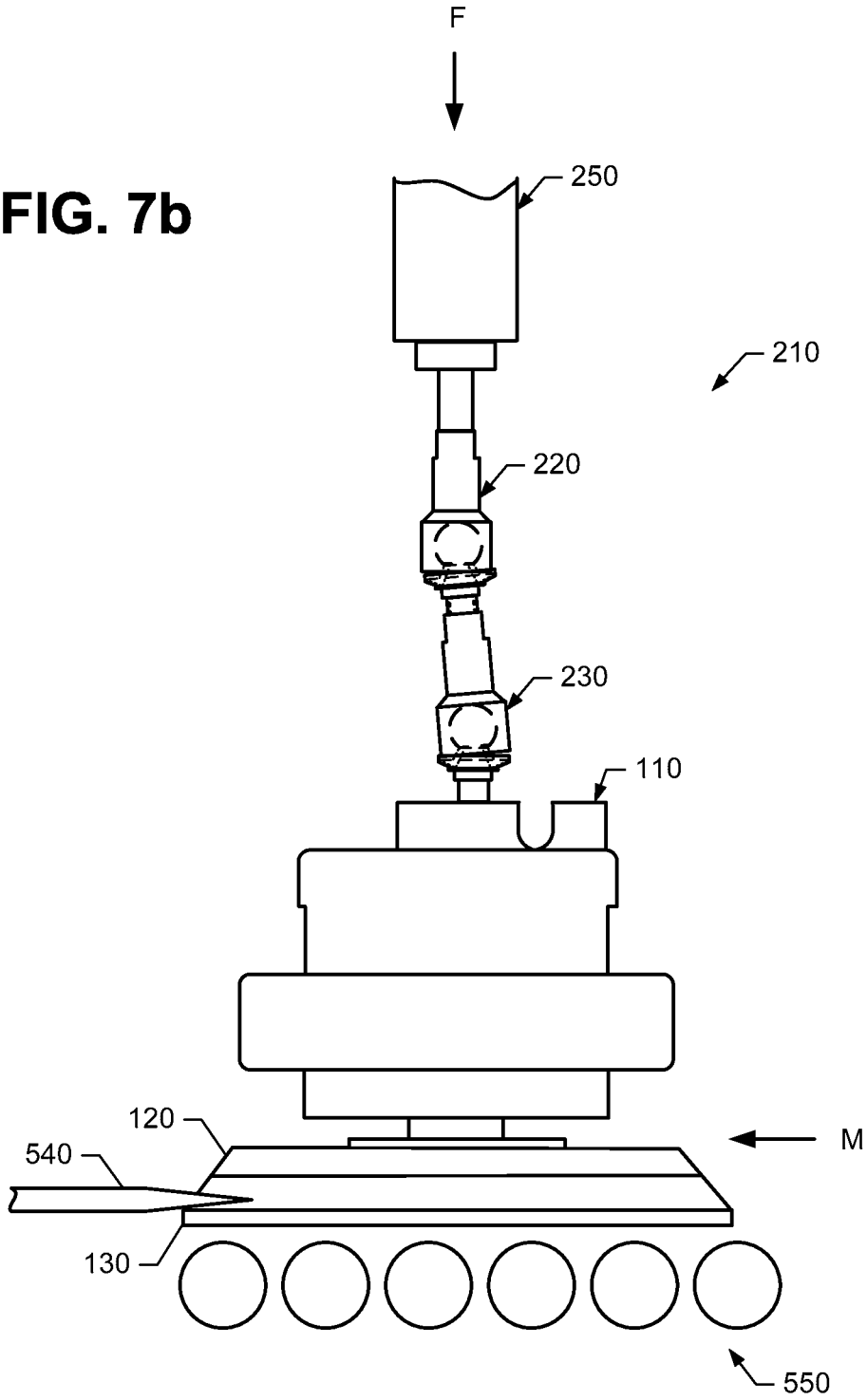
Figure 7C:
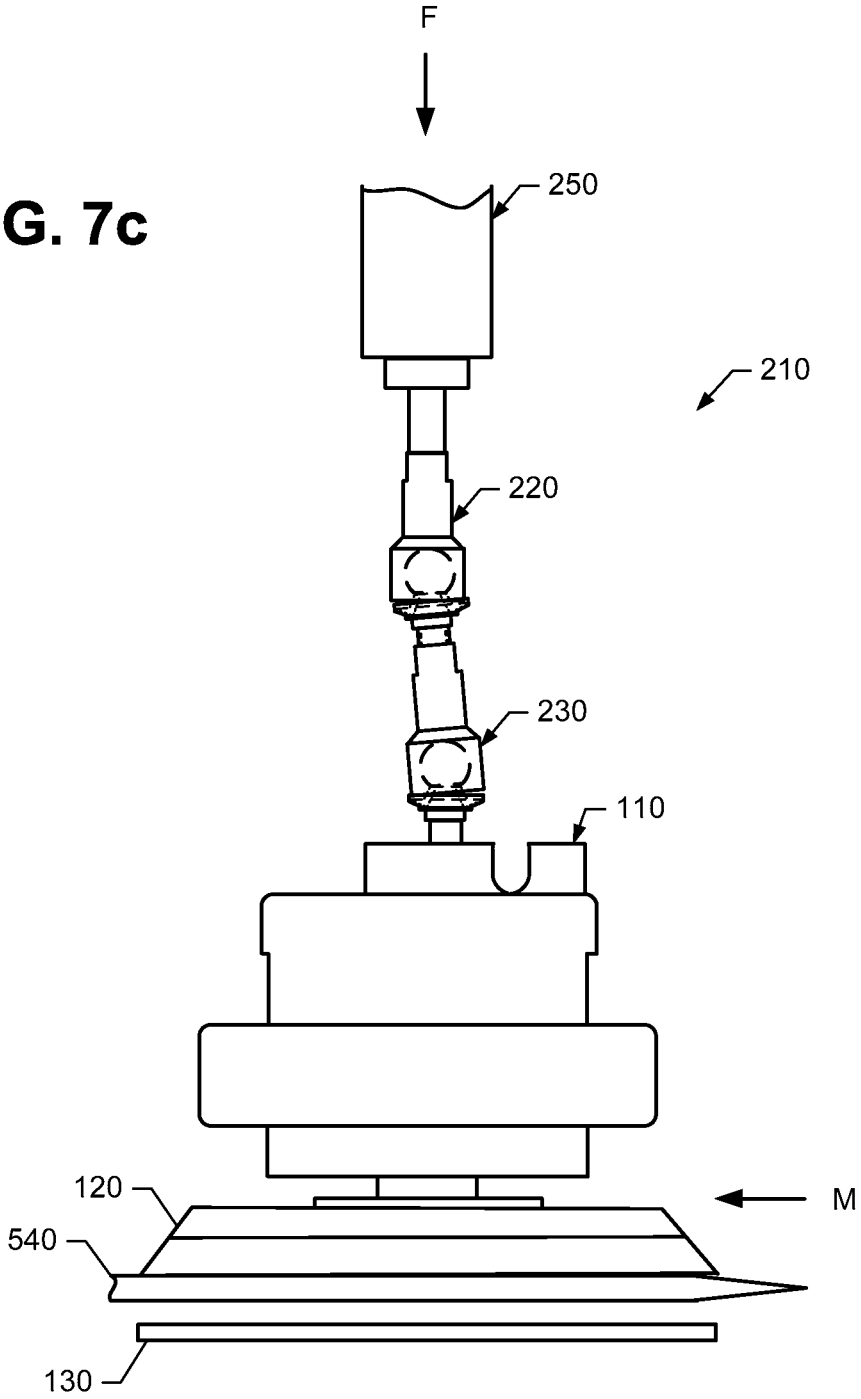

Reference is now made to FIGS. 7*a*, 7*b* and 7*c*, which illustrate how the backing pad 120 is moved to a known orientation. The device 110 includes a motor for moving the backing pad 120 in an elliptical orbit, while simultaneously spinning the backing pad 120. When the orbital sander 110 is turned off, the backing pad will move to a random position.

As shown in FIG. 7*a*, the sander 110 is placed on the roller table 550 and moved towards the wedge 530. Movement is in the direction of the arrow M. The linear actuator 250 applies a downward force as illustrated by the arrow F. The ball joints 220 and 230 are aligned, resulting in a downward force on the device 110.

As shown in FIG. 7*b*, the wedge 530 makes contact with the backing pad 120 and sanding disc 130. As the wedge tip 540 comes in contact and begins to separate the sanding disc 130 from the backing pad 120, frictional forces cause the ball joints 220 and 230 to hinge. The motor of the device 110 is allowed to adjust because the ball joints 220 and 230 are not fixed in the horizontal direction.

As shown in FIG. 7*c*, the sanding disc 130 is separated from the backing pad 120, and the sander 110 is moved over the wedge 530. Frictional forces continue to force the motor to an offset position (based on the design of the motor). Consequently, the backing pad 120 is moved to a known orientation. With the spent sanding disc 130 removed and the backing pad 120 moved to a known orientation, a new sanding disc 130 can be attached.

Figure 8:
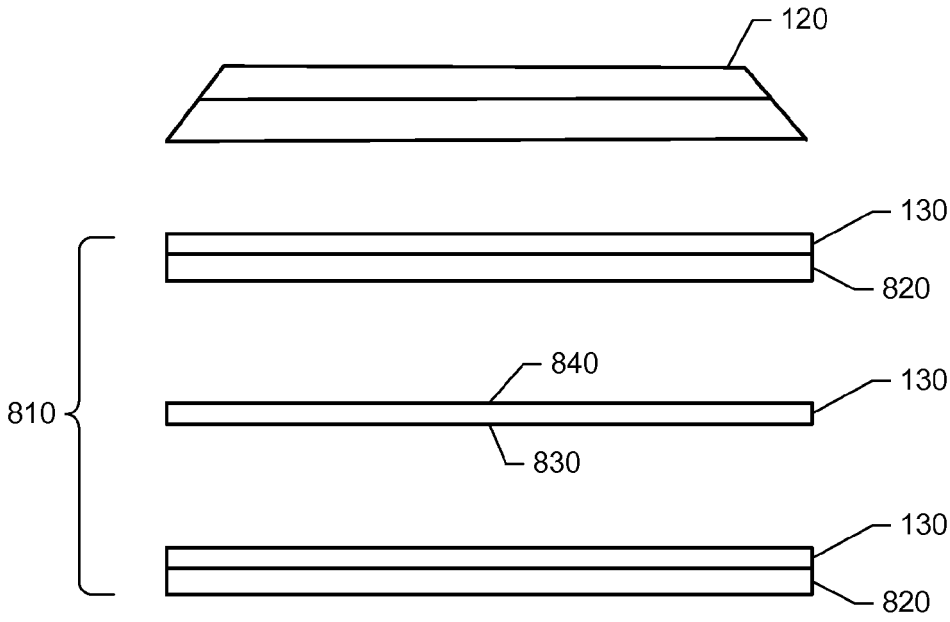
FIG. 8 is an illustration of a stack of sanding discs and metal discs.

Reference is now made to FIG. 8, which illustrates a stack 810 of sanding discs interleaved with thin (about 30 mils) metal discs 820. Each sanding disc 130 has grit material 830 on one side, and hook and loop material 840 on the opposite side. Each sanding disc 130 is placed above a corresponding metal disc 820. That is, the hook and loop material 840 is face up, and the grit material 830 is face down, resting on its corresponding metal disc 820.

Figure 9:
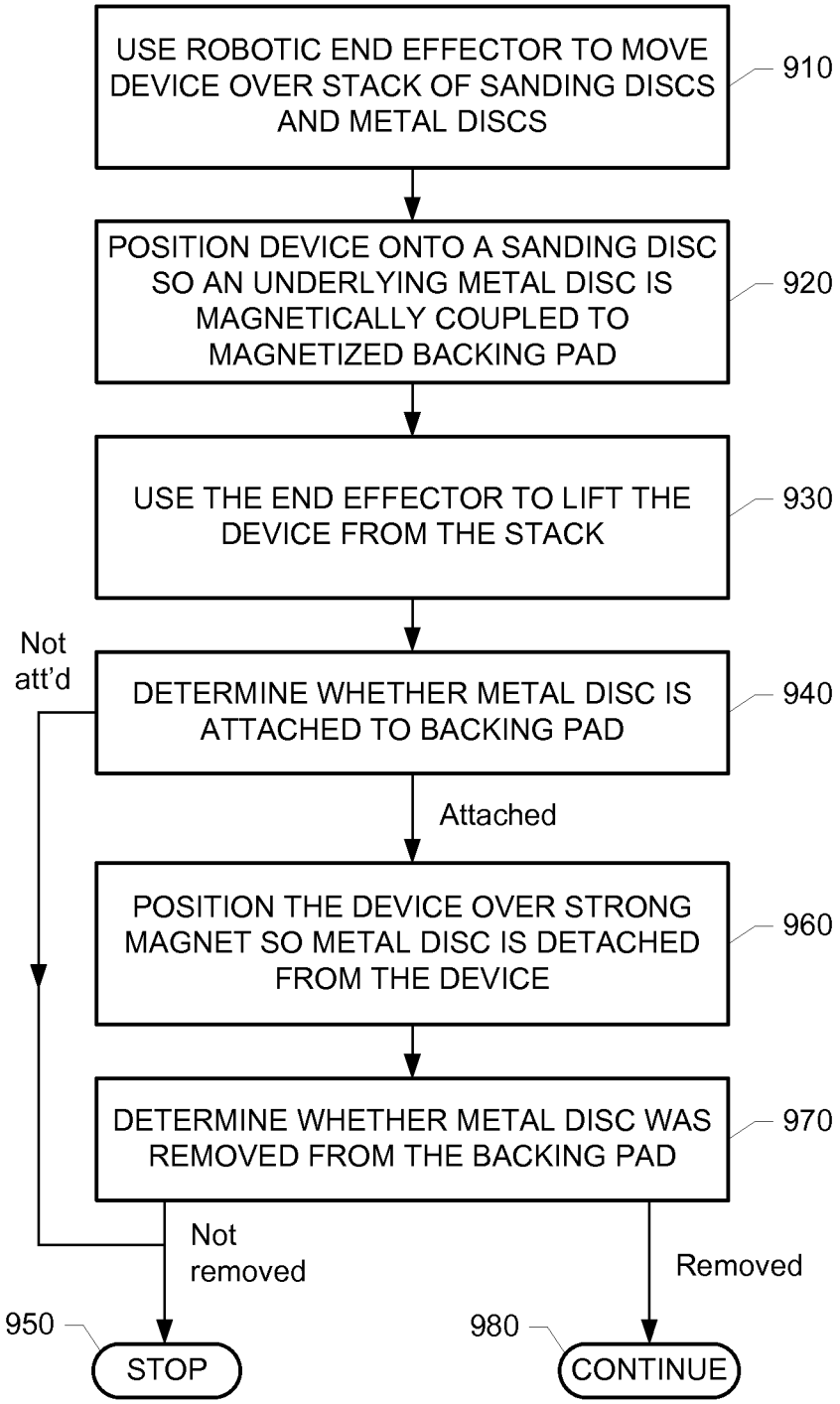
FIG. 9 is an illustration of a method for removing a spent sanding disc from a random orbital sander and attaching a new sanding disc to the sander, all without manual intervention.

Additional reference is made to FIG. 9. At block 910, the end effector 240 moves the device 110 over a stack 810 of sanding discs 130 and metal discs 820.

At block 920, the device 110 is positioned onto a sanding disc 130. The backing pad 120 has a magnetized portion (e.g., the perimeter) that magnetically attracts the underlying metal disc 820. As a result of this magnetic attraction, the underlying metal disc 820 is magnetically clamped to the backing pad 120, whereby a sanding disc 130 is clamped therebetween and thereby fastened to the backing pad 120.

At block 930, the end effector 240 then lifts the device 110 from the stack 610. At this point, the device 110 should be carrying both a sanding disc 130 and a metal disc 820.

At block 940, a determination is made as to whether the metal disc 820 was picked up. For example, the device 110 may be positioned over an optical sensor. If the metal disc 820 was picked up, the sensor will detect a reflection from the metal disc 820. If the metal disc 820 was not picked up, a reflection will not be detected (assuming the backing pad 120 does not reflect light), and the operation will be halted or stopped (block 950). Manual intervention could then be requested to attach a sanding disc 130 to the backing pad 120.

To detach the metal disc 820, the end effector 240 positions the device 110 over a removal magnet 570, which is at least as strong as the magnetized portion of the backing pad 120 (block 960). The removal magnet 570 pulls the metal disc away from the backing pad 120. The removal magnet 570 may be integrated with the platform 520 (as shown in FIG. 5).

In one embodiment, an edge of the backing pad 120 is placed over the removal magnet 570 and then pulled away. This gives the removal magnet 570 a force advantage by pulling on the metal disc 820 from the edge and thereby prying the metal disc 820 away from the backing pad 120. At this point, the metal disc 820 is temporally suspended between the removal magnet 570 and the magnetized portion of the backing pad 120. The removal magnet 570 is not strong enough strength to hold the metal disc 820 from its edge; consequently, the metal disc 820 falls under its own weight into a nearby retaining basket.

An optical sensor may be provided to sense whether the metal disc 820 has been removed from the backing pad 120 (block 970). For example, the optical sensor may be positioned just above the retaining basket. If the metal disc 820 is separated and falls towards the basket, the optical sensor will detect a reflection. This reflection will signal that the metal disc 820 was separated from the backing pad 120. The orbital sander 110 will then be used for sanding (block 980).

If a reflection is not detected, it will be assumed that the metal disc 120 was not detached from the backing pad 120. Therefore, the operation may be halted or stopped (block 950).

The attachment-removal system enables sanding media to be removed and attached without any manual intervention. By automating disc attachment and removal, human health hazards such as dust inhalation are eliminated.

The invention claimed is:

1. An apparatus for performing surface preparation, the apparatus comprising:

a surface preparation device for moving a backing pad in a random orbital motion;

a first ball joint connected to the device;

a second ball joint connected to the first ball joint; and a robotic end effector, connected to the second ball joint, for pressing the device against a surface.

2. The apparatus of claim 1, wherein the device is a random orbital sander.

3. The apparatus of claim 1, wherein the end effector includes a linear actuator, connected to the second ball joint, for applying constant pressure to the device.

4. The apparatus of claim 3, wherein the end effector and the linear actuator are rigid in a direction of pad motion.

5. The apparatus of claim 3, wherein the linear actuator includes a pneumatic double compression cylinder and a pressure regulator for regulating pressure in the cylinder so a constant force is applied to the device.

6. The apparatus of claim 1, wherein each ball joint has a rotation of no more than 15 degrees.

7. An apparatus for performing surface preparation, the apparatus comprising:

a surface preparation device for moving a backing pad;

a robotic end effector for pressing the device against a surface; and a platform and a wedge on a surface of the platform, the wedge having a shovel-nose tip for separating a medium from the backing pad.

8. The apparatus of claim 7, wherein the tip has a size and shape to separate middle portion of the medium from the backing pad disc before separating edges of the medium from the backing pad.

9. The apparatus of claim 7, further comprising surface rollers adjacent the wedge for moving the device towards the wedge tip.

10. The apparatus of claim 7, further comprising hook and loop material for securing the medium to the backing pad.

11. The apparatus of claim 7, further comprising a first ball joint connected to the device and a second ball joint connected between the first ball joint and the robotic end effector; wherein the device is configured to move the backing pad in a random orbital motion; and wherein the ball joints move the pad to a known location when the device is stopped by the wedge.

12. The apparatus of claim 11, further comprising means for automatically attaching media to the backing pad, including a holder for stacking media, and metal discs for separating the media; and wherein the backing pad has a magnetic portion for magnetically attracting one of the metal discs.

13. The apparatus of claim 12, the means further comprising at least one optical sensor positioned to determine whether a metal disc is attached to the backing pad.

14. A method comprising using the robotic end effector of claim 1 to prepare a surface of an aircraft for painting; and using another robotic end effector for painting the prepared surface.

15. An apparatus comprising:

a robotic end effector;

first and second ball joints connected serially; and a random orbital sander connected to the robotic end effector by the serially connected ball joints;

the end effector including a pneumatic cylinder connected to one of the ball joints, and a pressure regulator for applying constant pressure to the sander.

16. The apparatus of claim 15, wherein the ball joints have a rotation of no more than 15 degrees.

17. The apparatus of claim 15, wherein the pneumatic cylinder is a pneumatic double compression cylinder.

18. The apparatus of claim 15, wherein the medium is held to the pad via hook and loop material.

19. A method comprising using a robotic end effector coupled to a random orbital sander to attach and remove sanding media from a backing pad of the sander, wherein attaching a sanding medium includes:

stacking a plurality of sanding discs interleaved with thin metal discs, with each sanding disc being above its corresponding metal disc; and using the robotic end effector to move the sander, which has a magnetized backing pad, over the stack so that the metal disc is magnetically clamped to the backing pad, whereby a sanding disc is clamped between its corresponding plate and the backing pad and thereby fastened to the backing pad.

20. The method of claim 19, wherein removing the sanding medium includes using the robotic end effector to move the sander along a roller platform until the backing pad abuts against a shovel-nosed portion of a wedge and thereafter separates a sanding disc from the backing pad.

* * * * *